United States Patent [19]

Pättiniemi et al.

[11] 4,335,759

[45] Jun. 22, 1982

[54] METHOD OF MIXING PAINTS AND THEIR TONERS

[75] Inventors: Veikko Pättiniemi; Eero Koivisto, both of Pirkkala; Heikki Kokki; Aslak R. Heikel, both of Tampere, all of Finland

[73] Assignee: Winter Osakeyhtio, Tampere, Finland

[21] Appl. No.: 69,030

[22] Filed: Aug. 23, 1979

[30] Foreign Application Priority Data

May 10, 1979 [FI] Finland ..... 791500

[51] Int. Cl.[3] ..... B65B 3/04

[52] U.S. Cl. ..... 141/5; 141/9; 141/329; 220/203

[58] Field of Search ..... 220/203; 141/329, 330, 141/19, 1-12

[56] References Cited

U.S. PATENT DOCUMENTS

| | | | |
|---|---|---|---|
| 1,178,897 | 4/1916 | Wooden | 220/203 |
| 3,002,648 | 10/1961 | Rieke | 220/203 |
| 4,170,798 | 10/1979 | Krumdieck | 141/329 |

*Primary Examiner*—Houston S. Bell, Jr.
*Attorney, Agent, or Firm*—Ladas & Parry

[57] ABSTRACT

A machine for mixing paints and their toners, comprising a plurality of toner containers wherefrom required quantities of selected toners are added to a basic paint can. Each toner container is at its upper end provided with a back pressure valve allowing air to enter into the container as the toner level sinks but preventing air from leaving the container.

2 Claims, 3 Drawing Figures

METHOD OF MIXING PAINTS AND THEIR TONERS

The present invention relates to a method of mixing paints and their toners, employing a plurality of toner containers each provided with a dosing device including a nozzle for adding a required quantity of a toner to a basic paint can.

Toner containers in paint mixing machines have generally been so constructed that ambient air can relatively freely get into contact with the toner paste. For this reason, it has been necessary to make the toner paste such that it will not dry in the container, with the result that the paint on the surface of the painted object dries very slowly which is considered to be a disturbing drawback.

Attempts have been made to solve the problem by making the container airtight. Although this toner paste container as such functions satisfactorily, it has, mainly due to the pneumatic arrangements required in it, proved to be so expensive that so-called open containers have remained in extensive use, in particular in less expensive machines.

It is the object of this invention to solve the above drying problem of the toner paste in a novel, simpler manner and thereby to permit the use of quick-drying pastes on a large scale.

The method according to the invention is characterized in that ambient air is permitted to enter the container but the escape of air from inside the container is prevented.

The invention is based on the insight that there is little harm in allowing air to enter into the toner container provided care is taken not to permit a change of the air within the container. In order to minimize the drying action of the container air, it is possible to mix with the toner paste, as required, a suitable, easily vapourizing solvent which saturates the air within the container.

The invention is without any bigger difficulties applicable to new paint mixing machines as well as to those already in use; the containers need only be sealed, in particular their cover structures, and, consequently, a rapid transition to a large-scale use of quick-drying colouring pastes can be made.

A quick-drying toner paste also has a tendency to dry in the nozzle opening of the dosing devices, wherefore it is preferred to provide the nozzle with a closing means closing the nozzle opening at any other time except when the dosage is taking place. In a preferred embodiment of the invention this is achieved such that the nozzle opening is arranged to open laterally of the nozzle and that the closing means is shaped as a sleeve movable along the nozzle aginst the force of a spring whereby, as the nozzle penetrates through the cover in the basic paint can, the cover pushes the sleeve backwards along the nozzle to free the nozzle opening and, as the nozzle leaves the basic paint can, the sleeve will under the action of the spring force return and close the nozzle opening.

The invention will be described in the following with reference to an embodiment shown in the accompanying drawing.

Figure 1:
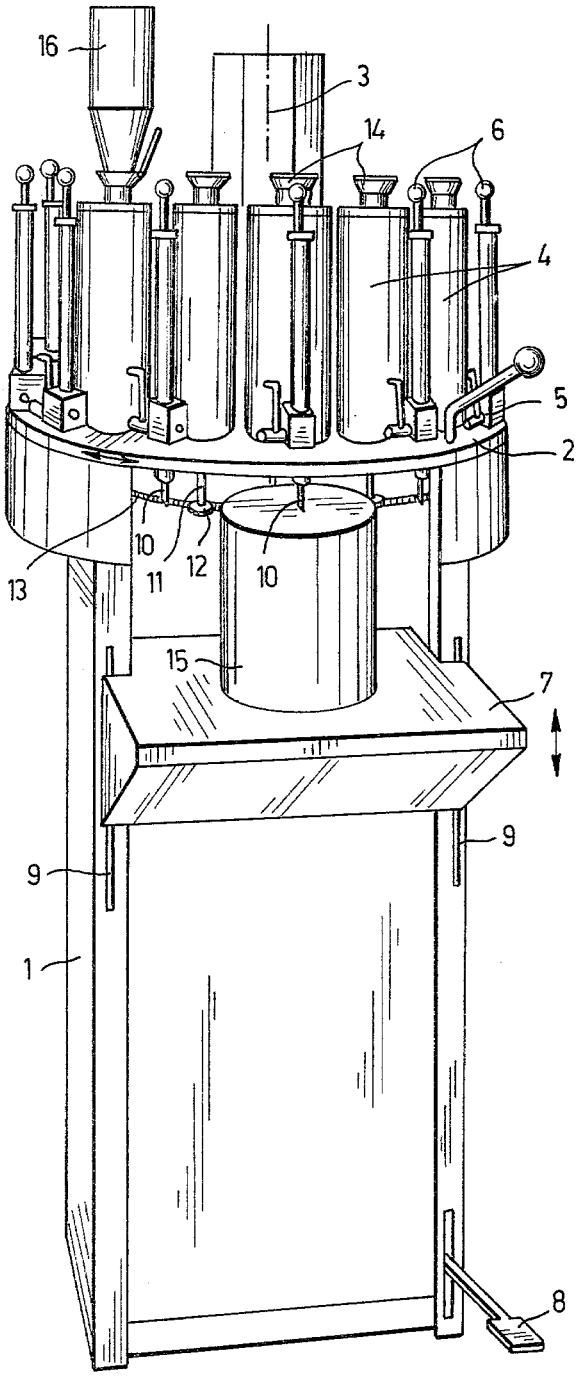
FIG. 1 is a general view of a paint mixing machine according to the invention.

The paint mixing machine shown in the drawing mainly comprises a frame 1, a support plate 2 mounted rotatably around a shaft 3, a plurality of toner containers 4 arranged on the support plate on the circumference of a circle around the shaft 3, a dosing device for each container comprising a valve 5 and a measuring (metering) cylinder with a piston 6 and a nozzle 10, and a taple top 7 which can be lifted and lowered in guides 9 by means of a pedal 8.

For carrying out the toning, a paint can 15 containing white basic paint is placed as such without opening the cover on the table top 7 of the machine, preferably into a circular groove provided in the table top. In the table top 7, for example, three concentric circular grooves have been grooved for three different paint can sizes. The pedal 8 is pressed down whereby the table is lifted up, while pushing the paint can against a nozzle spike 10. The spike penetrates the cover portion of the can, while forming in the hole so formed the necessary air outlets, and while bending the sharp edge portions in the hole to a position making it possible to retain a plastic plug to be inserted later in the hole. The selection, dosage and feed of the shading colour into the paint can through the spike take place in a way known per se by means of a paint chart and by using the piston in the measuring cylinder and the closing valve in the dosing device, for which reason this operation will not be described in more detail. If a plurality of toners are used in the operation, the respective toner containers will in turn be turned to the paint can, and the different colours will each in turn be fed through their respective spikes into the paint can such that each time a new hole is made in the can cover.

When the shading operation is finished, a plastic plug designed for this particular purpose is inserted in the hole formed in the cover of the paint can. The shape of the hole is so constructed that the plug will be very securely held in place during the mixing operation known per se.

Figure 2:
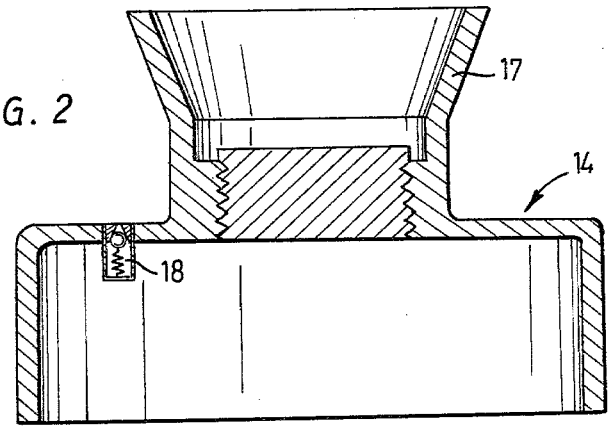
FIG. 2 is a sectional view of the upper end of a toner container.

The upper end 14 of each container 4, preferably the cover, is provided with a back pressure valve 18. As the level of the toner paste in the container 4 sinks, an underpressure will be generated therein due to which a corresponding quantity of air will be transferred from the environment through the back pressure valve into the container. In order to avoid any mistakes in dosing, the back pressure valve 18 should be sensitive. The back pressure valve may be of ball-and-spring type, as schematically indicated in FIG. 2, or of leaf type. The upper end of the container shown in FIG. 2 is provided with a filling opening 17 in which a filling bottle or similar can be placed upside down. Alternatively, the back pressure valve may be arranged in the closing plug for the filling hole, or it may be fixedly mounted in any other location in the cover.

Figure 3:
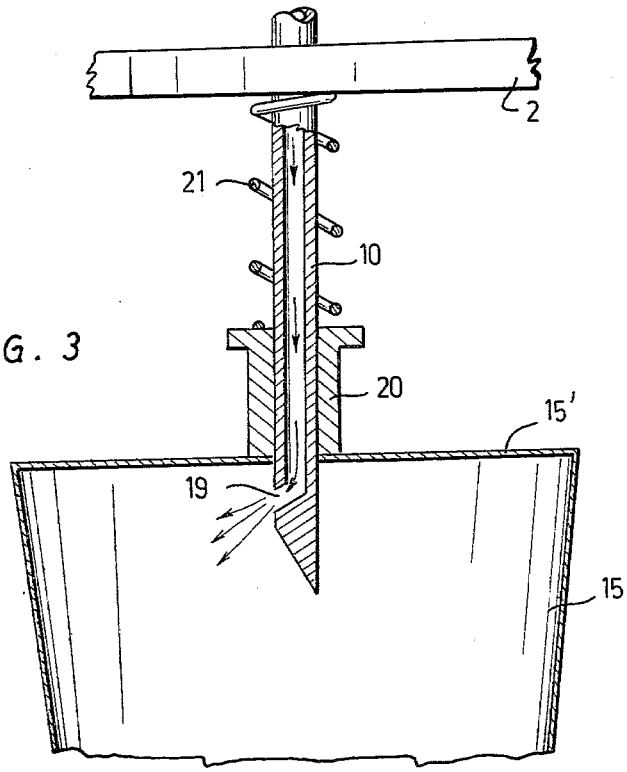
FIG. 3 illustrates the dosage situation in a preferred embodiment of the invention.

In order to prevent drying of the toner paste in the nozzle opening of the dosing device, this opening 19 is according to FIG. 3 preferably arranged to open laterally of the nozzle 10, while the nozzle is encircled by a sleeve 20 covering the opening 19 when the dosing device is not in operation. The sleeve 20 can slide along the nozzle 10 and is under the action of a spring 21 keeping the sleeve in the position in which the opening 19 is closed. The sliding of the sleeve 20 can be controlled, for example, by means of arranging a groove between the nozzle and the sleeve, in connection with which groove a stop can be arranged in order to prevent the sleeve from projecting too far beyond the tip of the nozzle, but also other solutions of a similar type may, naturally, come into question.

When the paint can 15 on the table 17 hits against the nozzle 10, the cover 15' of the can will lift the sleeve 20 against the spring 21, whereby the nozzle opening 19 that has penetrated into the can will be freed and, as the can 15 is again lowered down, the spring 21 will force the sleeve 20 back to close the opening 19.

What we claim is:

1. A method of mixing toner from a container of toner with basic paint in a basic paint can, the toner container having a dosing device which includes a nozzle and also having an opening for allowing air to enter the container, wherein the improvement resides in that, in order to prevent drying of the toner remaining in the container, said opening is provided with a back pressure valve which is disposed to allow air to enter the container and prevent air from leaving the container, and the method comprises the steps of employing the dosing device to withdraw a measured quantity of toner from the container, and introducing said measured quantity of toner into the basic paint can by way of the nozzle of the dosing device, withdrawal of toner from the container by way of the dosing device causing a reduction of pressure of air in the container so that the back pressure valve opens and allows air to enter the container and subsequently closes to prevent escape of air from the container and consequent drying of the toner remaining in the container.

2. A method as claimed in claim 1, wherein the nozzle is formed with an opening through which toner is discharged from the container, and contact between toner in said opening and the ambient air is prevented when the dosing device is inactivated.

* * * * *